United States Patent [19]

Cattaneo et al.

[11] Patent Number: 4,593,807

[45] Date of Patent: Jun. 10, 1986

[54] EQUIPMENT FOR THE LATERAL TRANSFERENCE OF PIPES

[75] Inventors: Filippo Cattaneo, Milan; Agostino Perrone, Limito, both of Italy

[73] Assignee: Innse Innocenti Santeustacchio S.p.A., Milan, Italy

[21] Appl. No.: 690,530

[22] Filed: Jan. 11, 1985

[30] Foreign Application Priority Data

Jan. 13, 1984 [IT] Italy ..... 19155 A/84

[51] Int. Cl.[4] ..... B65G 47/26

[52] U.S. Cl. ..... 198/457; 198/463.3; 198/360; 414/748

[58] Field of Search ..... 198/456, 457, 468.6, 198/463.3, 468.01, 360, 367, 598, 783; 414/748, 745, 15, 22

[56] References Cited

U.S. PATENT DOCUMENTS

| | | | |
|---|---|---|---|
| 701,024 | 5/1902 | Edwards | 198/468.6 |
| 1,021,582 | 3/1912 | Daniels et al. | 198/783 X |
| 3,129,805 | 4/1964 | Krahn et al. | 198/783 |
| 3,812,951 | 5/1974 | Fullaway | 414/748 X |

FOREIGN PATENT DOCUMENTS

| | | | |
|---|---|---|---|
| 52-1858 | 1/1977 | Japan | 414/22 |

*Primary Examiner*—Joseph E. Valenza
*Assistant Examiner*—Jonathan D. Holmes
*Attorney, Agent, or Firm*—Fleit, Jacobson, Cohn & Price

[57] ABSTRACT

Equipment for transferring pipes from one roller track to an adjacent parallel roller track includes at least two transfer units, each of which comprises a pipe chute extending transversely to the roller tracks and movable angularly between a lowered position below the tracks and a raised position above the tracks. In the raised position the chute is inclined downwardly, so that a pipe lifted by the chute rolls along the latter and comes to rest on a curvilinear end portion of the chute when it reaches a position above the roller track onto which the pipe is to be transferred.

2 Claims, 5 Drawing Figures

EQUIPMENT FOR THE LATERAL TRANSFERENCE OF PIPES

The present invention provides equipment for the lateral transference of pipes in, for example, a pipe rolling mill. More particularly this invention relates to equipment for transferring pipes laterally from one roller track to another roller track which extends parallel to and alongside the first.

It is known that in rolling mills it is often necessary to move the pipes being worked between two or more parallel and adjacent pipe conveyor tracks, for example between one roller track extending from the delivery of one working stage to a roller track entering another working stage, with possible transfer and/or parking of the pipes upon intermediate roller tracks.

In order to satisfy such a need, it is known to provide transfer devices of the type which consists fundamentally of a plurality of mechanical levers or arms extending transversely between the roller tracks in question and arranged for movement substantially in synchronism. The connection and reciprocal linkage of such levers or arms generally comprises a considerable number of articulated joints, control and drive mechanisms, mechanical transmissions, synchronising devices, slide guides, etc., all of which, as is well known, impart considerable complexity both to the structure and to the operation of transfer devices of this type.

A first resultant disadvantage of such known transfer devices is the possibility of jamming, yielding etc. which may also require stopping of the production cycle of the rolling mill. This possibility is moreover increased by the fact that the transfer devices may operate in a hostile environment both by virtue of high temperature and also by virtue of the presence of dust, water, metal scales and the like.

Taking into account the fact that in a pipe rolling mill production is continuous, it is clear that any stoppage, long or short, always causes a not inconsiderable economic loss.

A further disadvantage lies in the fact that during lateral transference the pipes undergo impacts, which may be heavy, caused by the mechanical levers and arms of the transfer devices, with a consequent possibility of unacceptable distortions.

The object of the present invention is that of providing equipment for the lateral transference of pipes in a pipe rolling-mill which has structural and functional characteristics such as to overcome the disadvantages, referred to above, with reference to the prior art.

This object is resolved, according to the invention, by equipment for the lateral transference of pipes from one roller track to an adjacent parallel roller track, comprising at least two identical transfer units, spaced apart in the direction of the said roller tracks, wherein of the said transfer units comprises a horizontal shaft extending perpendicularly to the roller tracks and below them, a pipe chute supported cantilever-fashion by said shaft and extending transversely to the said roller tracks, the said pipe chute having an intermediate rectilinear portion converging with the said horizontal shaft towards the roller track onto which a pipe is to be transferred, a curvilinear end portion, with its convex part turned towards the shaft and extending across the said roller track, and an end portion directed away from the said shaft and extending across the roller track from which the said pipe is to be transferred, and means for moving the said pipe chute angularly about the axis of the said shaft between a lowered position in which it is completely below the said roller tracks and a raised position in which it is completely above them.

Further characteristics and advantages of the invention will be clearer from the detailed description of one embodiment of transference equipment according to the said invention, given purely by way of non-limiting example, with reference to the accompanying drawings, in which.

Figure 1:
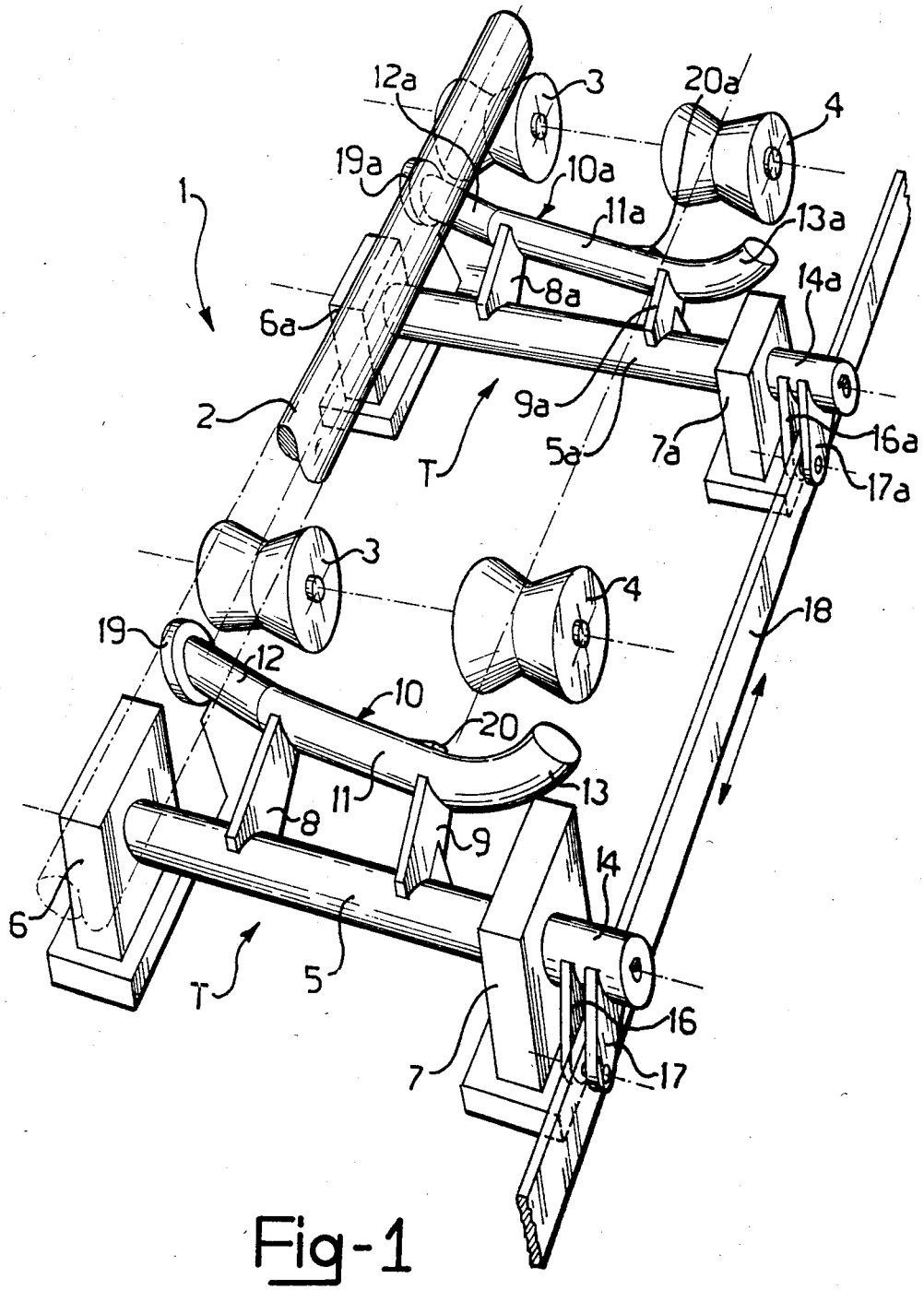
FIG. 1 shows in perspective and diagrammatically equipment for the lateral transference of pipes according to the invention.

In FIG. 1 of the accompanying drawings there is shown diagrammatically in perspective, indicated generally as 1, equipment for the lateral transference of a pipe 2 in a rolling mill, more particularly for the transfer of a pipe 2 from one track with biconical rollers 3 to another track with biconical rollers 4 parallel to and alongside the first; for clarity in the drawing, the supports and the drives of the biconical rollers previously referred to are not shown since they are entirely conventional.

Transference equipment according to the invention comprises at least two transfer units T, identical and spaced apart in the direction in which the roller tracks 3 and 4 extend. These transfer units are supported and extend transversely to the roller tracks 3, 4 in question, and since they are identical, in the course of this description only one transfer unit will be described. All the elements which constitute the other transfer unit and which are identical to the elements which will be described for the first transfer unit will have the same reference numerals with the addition of the suffix a.

Each transfer unit comprises a horizontal shaft 5 rotatably supported by a pair of supports 6, 7, positioned outside the roller tracks 3, 4 below which and perpendicularly to which the said shaft 5 extends.

Two arms 8, 9, parallel to each other and of different length, are affixed cantilever-fashion to the said shaft 5, and extend radially relative to the same, from the same side and in positions thereon between the roller tracks 3, 4. The arm 8, nearer to the roller track 3, is of greater length than the arm 9.

To the free ends of the said arms 8, 9, there is affixed a pipe chute 10, comprising an intermediate rectilinear portion 11 and two end portions 12, 13, disposed in correspondence with the roller tracks 3 and 4 respectively. By virtue of the different lengths of the arms 8, 9, the aforesaid intermediate portion 11 of the pipe chute 10 and the shaft 5 converge towards the roller track 4.

The end portion 13 is curved away from the said shaft 5 in a sense such as to present its convex side towards the shaft 5. The said end portion 13 has its longitudinal axis coplanar with the longitudinal axes of the intermediate portion 11 and the shaft 5.

The end portion 12 is rectilinear and is directed away from the said shaft 5 in the same direction as the end portion 13, but is skew with respect to the said shaft 5.

More particularly, looking at the pipe chute 10 in a position in which the intermediate portion 11 and its end portion 13 are horizontal, the end portion 12 is inclined away from the said shaft 5, and downwards relative to the roller track 3.

Figure 2:
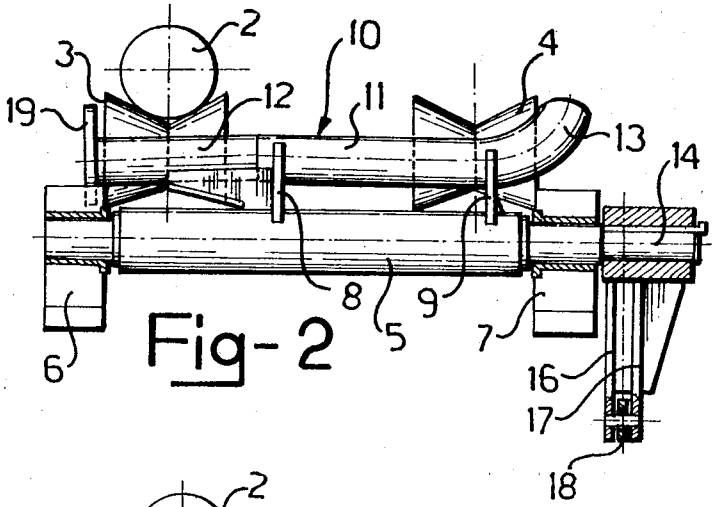
FIG. 2 shows diagrammatically in the rest position and in side elevation one of the transfer units of equipment for the lateral transference of pipes according to the invention.
Figure 5:
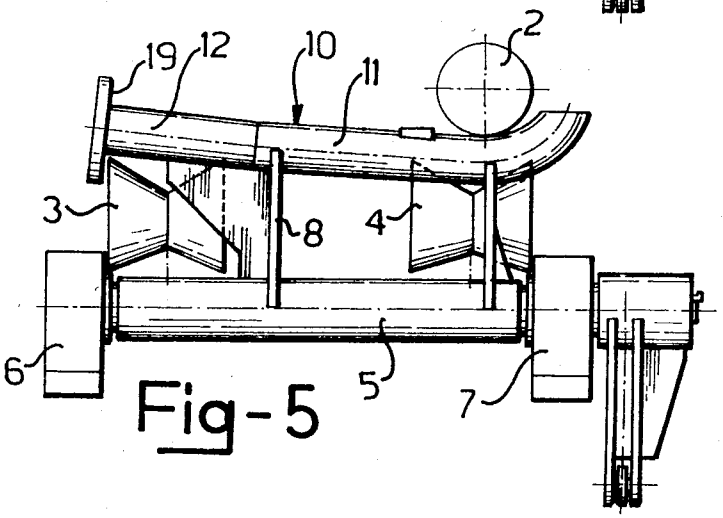

The pipe chutes 10, 10*a* of the two (or more) transfer units T of the equipment of this invention are designed to be moved angularly in synchronism about the axes of the respective shafts 5, 5*a* from a position in which they are completely below the roller tracks 3, 4 (non-operational position—FIG. 2), to a position in which they are completely above the said roller tracks (FIG. 5).

For this purpose the shafts 5, 5*a* have respective portions 14, 14*a*, outside, for example, the supports 7, 7*a*, connected mechanically, for example, by pairs of lugs 16, 17 and 16*a* and 17*a*, to a single connecting rod 18 to which a reciprocating movement is applied (FIG. 1).

In order to transfer a pipe 2 from the roller track 3 to the adjacent parallel roller track 4, the following sequence of operations is effected.

Figure 3:
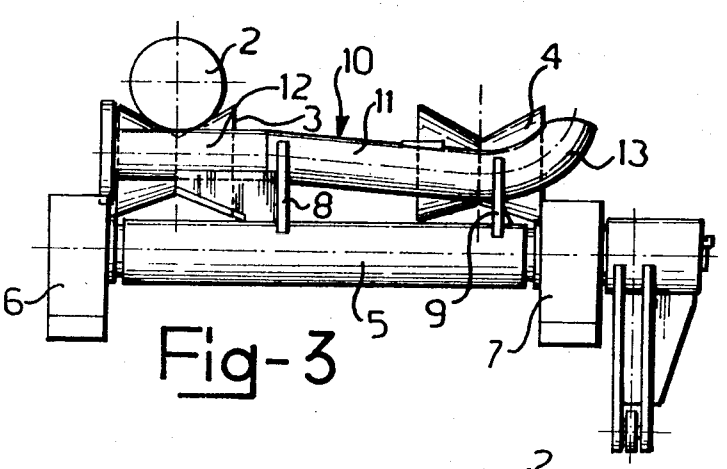
FIGS. 3, 4 and 5 show diagrammatically and in lateral view the said transfer unit of FIG. 2 in successive operating positions for the lateral transference of a pipe.

In the initial state the pipe chutes 10, 10*a* are in an inoperative position, completely below the aforementioned roller tracks. By displacing the connecting rod 18, the said pipe chutes 10, 10*a* are moved angularly in synchronism about the longitudinal axes of the respective shafts 5, 5*a* until the end portions 12, 12*a* come into contact with the pipe 2. It must be pointed out that when this contact occurs the end portions 12, 12*a* are horizontal (FIG. 3), and extend diagonally relative to the axis of the pipe 2, and, hence to the roller track 3.

Continuing with the aforesaid angular movements, the end portions 12, 12*a* occupy successively higher positions above the roller track 3, becoming at the same time more inclined downwards and towards the adjacent, parallel roller track 4. In this manner the pipe 2, lifted up by the said end portions 12, 12*a* is safely prevented from rolling in an unwanted direction. However, in order to eliminate completely the risk of the said pipe 2 rolling to the outside of the roller track 3 in question, the end portions 12, 12*a* previously referred to are fitted at their respective free ends with stops 19, 19*a* consisting, for example, of discs affixed coaxially to the heads of the end portions 12, 12*a* and which have an external diameter greater than the diameter of the chutes 10, 10*a*.

Figure 4:
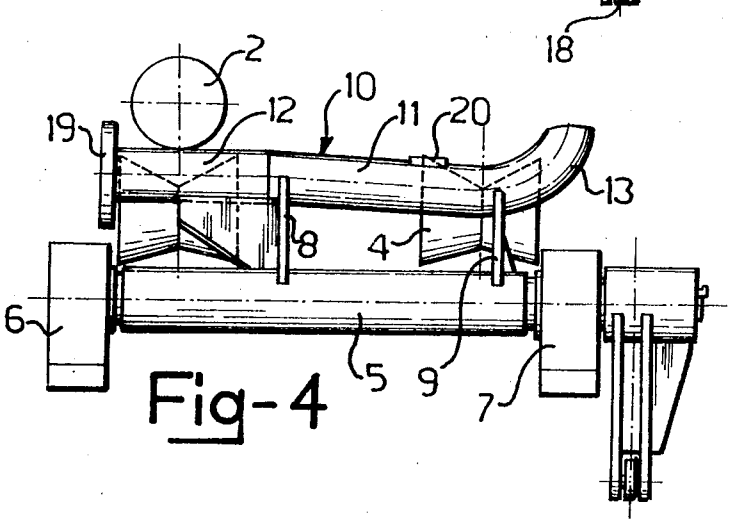

It must be pointed out (FIGS. 4 and 5) that as soon as the end portions 12, 12*a* have raised the pipe 2 out of the biconical rollers 3, the remaining portions, that is, the intermediate portions 11, 11*a* and curvilinear end portions 13, 13*a* will be completely above the roller track 4, the intermediate portions 11, 11*a* being inclined downwards and towards the latter roller track.

The pipe 2 can then roll as far as the curvilinear end portions 13, 13*a* where it is gently stopped. The pipe 2 is then lowered onto the roller track 4 by the angular movements of the pipe chutes 10, 10*a* about the axes of their respective shafts 5, 5*a*, in the opposite direction to that described previously, by displacing the connecting rod 18 in the opposite direction.

It must be pointed out that the said chutes 10, 10*a* may with advantage be furnished, at the start of the curvilinear end portion 13, with projections 20 and 20*a* respectively so dimensioned as to facilitate a more rapid stopping of the pipe 2 as it rolls onto them.

We claim:

1. Equipment for the lateral transference of pipes from one roller track to an adjacent parallel roller track, comprising at least two identical transfer units spaced apart in the direction of the said roller tracks, wherein each said unit comprises a horizontal shaft extending perpendicularly to the roller tracks and below them, a pipe chute supported cantilever-fashion by said shaft and extending transversely to the said roller tracks, said pipe chute having: an intermediate rectilinear portion converging with said horizontal shaft towards the roller track onto which a pipe is to be transferred; a curvilinear end portion with a convex part turned towards the shaft and extending from one end of said intermediate portion and across the said roller track to which the said pipe is to be transferred, and an end portion directed away from the said shaft and extending from the other end of said intermediate portion and across the roller track from which the said pipe is to be transferred, and means for moving the said pipe chute angularly about the axis of said shaft between a lowered position in which it is completely below said roller tracks and a raised position in which it is completely above them.

2. Equipment as defined in claim 1, wherein said end portion of the pipe chute directed away from the said shaft is rectilinear and is skewed with respect to said shaft, such that said end portion is inclined downwardly away from the roller track onto which the pipe is to be transferred when the intermediate portion of the pipe chute is horizontal and below said roller tracks, said skew end portion assuming an inclination downwardly towards said roller track onto which the pipe is to be transferred as the pipe is lifted on the pipe chute from the roller track across which said end portion extends, upon movement of the pipe chute to its raised position.

* * * * *